US008210393B1

(12) United States Patent
Nasrallah

(10) Patent No.: US 8,210,393 B1
(45) Date of Patent: Jul. 3, 2012

(54) TISSUE DISPENSING DEVICE

(75) Inventor: Jeffrey Nasrallah, Honolulu, HI (US)

(73) Assignee: Prodius, LLC, Honolulu, HI (US)

( * ) Notice: Subject to any disclaimer, the term of this patent is extended or adjusted under 35 U.S.C. 154(b) by 0 days.

(21) Appl. No.: 13/012,301

(22) Filed: Jan. 24, 2011

(51) Int. Cl.
*B65H 1/00* (2006.01)
*A47K 10/24* (2006.01)

(52) U.S. Cl. ..... 221/54; 221/53; 221/48; 221/38; 221/41

(58) Field of Classification Search ..... 221/33, 221/36–38, 41, 47–48, 53–55
See application file for complete search history.

(56) References Cited

U.S. PATENT DOCUMENTS 3,207,360 A 9/1965 Scott
3,266,665 A 8/1966 Eakens
3,269,593 A 8/1966 Lodewick et al.
3,473,694 A 10/1969 Murphy et al.
3,606,082 A 9/1971 Kuchenbecker
3,994,417 A 11/1976 Boedecker
5,088,620 A * 2/1992 Kelliher et al. ..... 221/59
5,540,354 A 7/1996 Annand
7,273,156 B2 9/2007 Gao
7,926,680 B2 * 4/2011 Leitner ..... 221/59

* cited by examiner

*Primary Examiner* — Michael K Collins
(74) *Attorney, Agent, or Firm* — Leighton K. Chong

(57) ABSTRACT

A tissue dispensing device for use with a standard tissue carton is formed as a helical coil spring that is highly stretchy and has a top coil that is fastened around a dispenser aperture in a top surface of the tissue carton with the remainder of the helical coil spring inserted into a space between the top surface of the tissue carton and top of the stack of tissues within the carton with a bottom coil thereof resting on top of the stack of tissues. The helical coil spring forms an open circular space within its coils under gravity that provides a vertically-extending support structure for supporting a tissue next to be dispensed from the tissue stack in a vertical standing position with a leading part thereof extending through a membrane opening of the dispenser aperture of the tissue carton to enable a user to grasp the leading part to withdraw the next tissue to be dispensed.

20 Claims, 5 Drawing Sheets

TISSUE DISPENSING DEVICE

TECHNICAL FIELD

This invention disclosure relates to a device for facilitating the dispensing tissues from a carton of interleaved folded tissues, and particularly to a dispensing device that prevents "fall back" of a leading tissue from an aperture of the carton.

BACKGROUND

Tissues are normally dispensed sequentially from a carton of interleaved folded tissues through a dispensing aperture formed by perforation located on the top face of the tissue carton. As a leading tissue projecting through the aperture is pulled from the carton, a following tissue interleaved with the leading tissue is drawn upward by the dispensing action so that it can be retained by the dispensing membrane which is part of the dispensing aperture of the carton. The repetition of the action of replacing the dispensed tissue with a fresh candidate for later dispensation works well when the tissue box is newly opened. The lead flap of the tissue which protrudes from the carton awaiting dispensation is grasped by the taut dispensing membrane leaving the trailing flap of the tissue at least partly interleavingly engaged with the next tissue so that it can be drawn upward as the next replacement tissue.

As the distance between the top of the tissue carton and the top of the supply stack of interleaved tissues within the carton increases, the interleaving engagement of the trailing flap of the fresh tissue with the next tissue becomes less secure. Frequently, dispensation failure or "fall back" occurs when the lead flap of a tissue falls back into the box from being retained by the aperture dispensing membrane. "Fall back" or "fall out" or "loss of flap" is the term given when the dispensing flap or lead flap of the tissue is not extended through the dispensing opening so that no lead flap is readily available for grasping by the user.

The most common dispensation problem for "fall back" is related to the distance between the top of the tissue supply stack and the carton dispensing opening. The use of larger volume cartons presents a problem as the tissue supply stack lowers within the larger cartons, as the tissue being dispensed must raise the following tissue a greater distance to pull its leading flap through the carton's dispensing membrane. If the height that a tissue must be raised is too great, the tissue being dispensed parts from the following interleaved tissue before the leading flap of the following tissue is raised high enough through the carton aperture for secure holding by the dispensing membrane and "fall back" occurs. The user must then stick their hand through the aperture inside the carton to pull a tissue from the top of the supply stack for dispensation. The insertion of the user's hand into the carton stretches and damages the cartons dispensing membrane which reduces its ability to hold a tissue in the raised position, further increasing the probability of "fall back". Another problem related to the user sticking their hand inside the carton to remove a tissue is that the user usually pinches several tissues out together which results in wasted tissue and frustration to the user.

The prior art has provided numerous attempts to solve the "fall back" problem in tissue dispensation. For example, U.S. Pat. No. 3,207,360 to Scott discloses a tissue dispenser with a free-resting control plate that moves up with withdrawal of a tissue and descends down on the trailing end of the next tissue to maintain friction to keep it in an upstanding manner to allow the leading end to be grasped on the next tissue withdrawal. U.S. Pat. No. 3,266,665 to Eakens discloses a tissue dispenser with a free-resting control panel that moves up with withdrawal of a tissue and descends into the box to put frictional pressure on the trailing end of the next tissue to keep it in a standing position. U.S. Pat. No. 3,269,593 to Lodewick et al. shows a drop-back panel that rests on the top of the tissue stack. U.S. Pat. No. 3,473,694 to Murphy et al. discloses a tissue dispenser with a depending serving flap that has one side attached to the top of the carton and its free end movable to rest on the supply stack. U.S. Pat. No. 3,606,082 to Kuchenbecker discloses a tissue dispenser with a follower-like control member having an upper sheet member attached to the top of the container and a lower sheet member that is suspended from it and hangs down onto the top of the tissue stack. U.S. Pat. No. 3,994,417 to Boedecker discloses a towelette dispenser with a movable barrier with a narrow aperture that moves upward on withdrawal of a towelette and descends back down on top of the towelette roll as it is used. U.S. Pat. No. 5,540,354 to Annand discloses a tissue dispenser with a free-resting internal control plate that is intended to maintain the trailing end of the next tissue in an upright condition and maintain a guiding friction on the tissues as they are dispensed. U.S. Pat. No. 7,273,156 to Gao et al. discloses a tissue dispenser where a top portion is telescoped over a bottom portion of the container such that it moves downward as the tissue stack is drawn down and keeps the dispenser opening within a small distance from the top of the stack of tissues.

However, the proposed solutions of the prior art in general are mechanically complicated and susceptible to misalignment or failure, and also are formed within the carton at the time of manufacture and not adapted for convenient retrofit to existing cartons. The present invention seeks to provide a tissue dispensing device for facilitating tissue dispensation that is simple in construction and not susceptible to misalignment or failure, while also being adaptable for convenient retrofit to existing cartons.

SUMMARY OF INVENTION

In accordance with the present invention, a tissue dispensing device is formed as a helical coil spring that is highly stretchy and has a top coil provided with means for fastening around a tissue-dispenser aperture formed in a top surface of a tissue carton while the remainder of the helical coil spring is inserted into a space between the top surface of the tissue carton and top of a stack of tissues within the carton with a bottom coil thereof resting on top of the stack of tissues. The helical coil spring forms an open circular space within its coils under gravity that provides a vertically-extending support structure for supporting a tissue next to be dispensed from the tissue stack in a vertical standing position with a leading part thereof extending through a membrane opening in the dispenser aperture of the tissue carton to enable a user to grasp the leading part to withdraw the next tissue to be dispensed.

In a preferred embodiment, the fastening means is formed by a top coil having conjoined upper and lower coil portions that can be inserted above and below opposite sides of at least one lateral side of the tissue-dispenser aperture. The conjoined portions may be formed by welding or fastening the first two turns of the helical coil spring together at points diametrically opposite each other to create cantilevered, semicircular upper and lower portions that clip onto at least one lateral side of the dispenser aperture. The top coil may have its other semicircular portion abutting the top surface on the other lateral side bounding the dispenser aperture, or may be formed with upper and lower portions to clip onto the other lateral side of the dispenser aperture.

The helical coil spring may be formed of a material and with thin dimensions so as to be very light in weight and capable of stretching easily to an extended length, such as one or more times greater than its diameter. Examples of highly stretchy material include a coil spring formed of a low-density plastic ribbon or flat metal wire. The bottom coil may have its end fastened to a coil turn just above it to form a smooth terminal portion. The smooth terminal portion prevents tissues from snagging on the bottom coil or becoming stuck on the bottom coil during tissue dispensation. The smooth terminal portion may be formed by welding the coil end to the coil turn just above it, or by using a brace or sleeve to connect the end to the adjacent coil above it. The tissue dispensing device may be pre-installed on a manufactured carton or retrofitted by insertion onto the top surface of an existing carton.

A first tissue in the carton can thus be pulled up from the top of the stack through the hollow of the coil and retained by a dispensing membrane formed in the dispenser aperture. As successive following tissues are pulled and the top of the stack of tissues lowers within the carton, the stretchy helical coil spring stretches commensurately to the top of the tissue stack by gravity and the bottom coil rests upon and maintains a light downward pressure on the stack of tissues. When a leading tissue is pulled from the carton, the bottom coil of the helical coil spring moves upward with the following tissue interleaved with the leading tissue until it reaches and is retained by the dispenser membrane at top of the box, then the bottom coil gently slides back down by gravity to again rest on the next tissue at the top of the stack of tissues. This up-and-down springing movement allows each tissue to be dispensed while the following tissue's leading flap is pulled upward with it to the dispensing aperture so that it is ready to be dispensed next.

Other objects, features, and advantages of the present invention will be explained in the following detailed description of the invention having reference to the appended drawings.

DESCRIPTION OF EMBODIMENTS

In the following detailed description of the invention, a preferred embodiment is illustrated providing certain specific details of their implementation. However, it will be recognized by one skilled in the art that many other variations and modifications may be made given the disclosed principles of the invention.

This invention is directed particularly to a dispensing problem that arises with the use of larger size tissue cartons (holding 300 to 400 tissues instead of the 100 to 200 tissues of smaller sized cartons). Consumer complaints became apparent due to the faulty tissue dispensation from these larger-sized tissue cartons. Unsatisfactory tissue dispensation occurred for a number of reasons, but the most prominent is "fall back," wherein a following tissue drops back through the dispensing opening after the leading tissue has been dispensed.

Figure 1:
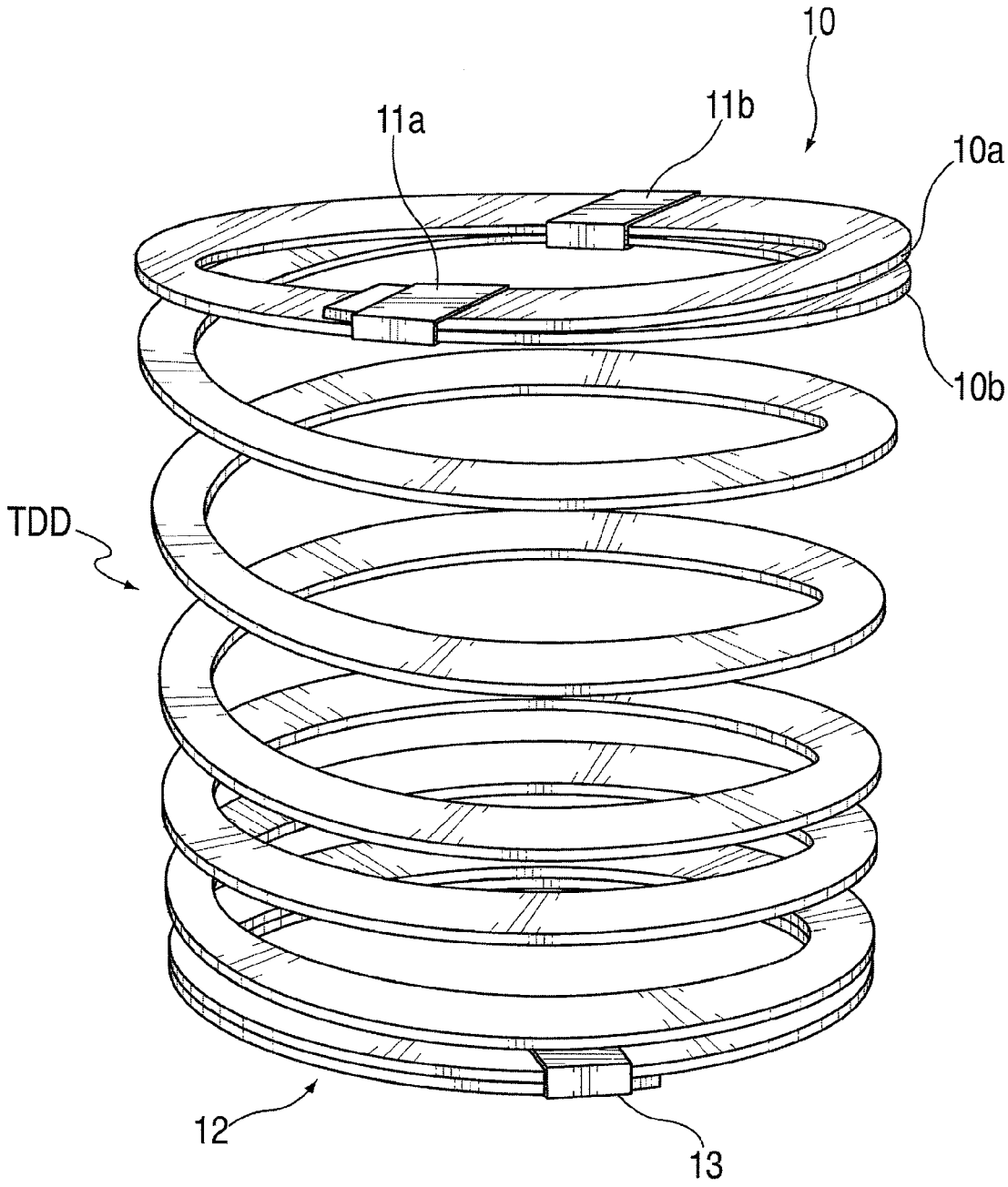
FIG. 1 illustrates a tissue dispensing device in the form of a helical coil spring in accordance with the invention.

Referring to FIG. 1, a tissue dispensing device TDD in accordance with the invention is formed in preferred form as a helical coil spring that is highly stretchy and has a top coil provided with means for fastening around a dispenser aperture in a tissue carton. The helical coil spring is formed of a material and with thin dimensions so as to be very light in weight and capable of stretching easily to an extended length, such as one or more times greater than its diameter. Examples of highly stretchy material include low-density plastic ribbon or a flat metal wire. In the figure, the device is shown in a fully stretched position by its own weight under gravity. In a preferred embodiment, the fastening means for the helical coil spring is provided by the top coil 10 having the first two turns of the coils connected to one another with fastener clips or sleeves 11*a*, 11*b* fastened at two points diametrically opposite each other to create cantilevered, semicircular portions 10*a*, 10*b* for clipping onto at least one lateral side of the dispenser aperture of the tissue carton. Alternatively, top coil portions may be fastened together by welding the first two coil turns at the two opposite points to create the cantilevered portions that clip onto the side of the tissue carton dispenser aperture. The top coil may have its other semicircular portion abutting the top surface on the other lateral side bounding the dispenser aperture, or may be formed with upper and lower portions to clip onto the other lateral side of the dispenser aperture.

Also shown in FIG. 1 is a bottom coil 12 having its end fastened to the coil turn just above it to form a smooth terminal portion 13 that will rest on the top of the tissue stack with a smooth surface to prevent tissues from snagging on the bottom coil or becoming stuck on the bottom coil during tissue dispensation. The smooth terminal portion 13 may be formed by welding the coil end to the coil turn just above it. An alternative method to joining coils instead of welding is to use a brace or sleeve to connect adjacent coils. The end of the coil would be inserted into the sleeve and the sleeve would then be slid around the coil until it makes a full revolution, then the end of the coil would be re-inserted into the sleeve for a tight fit that would clamp the two coils together.

Figure 2:
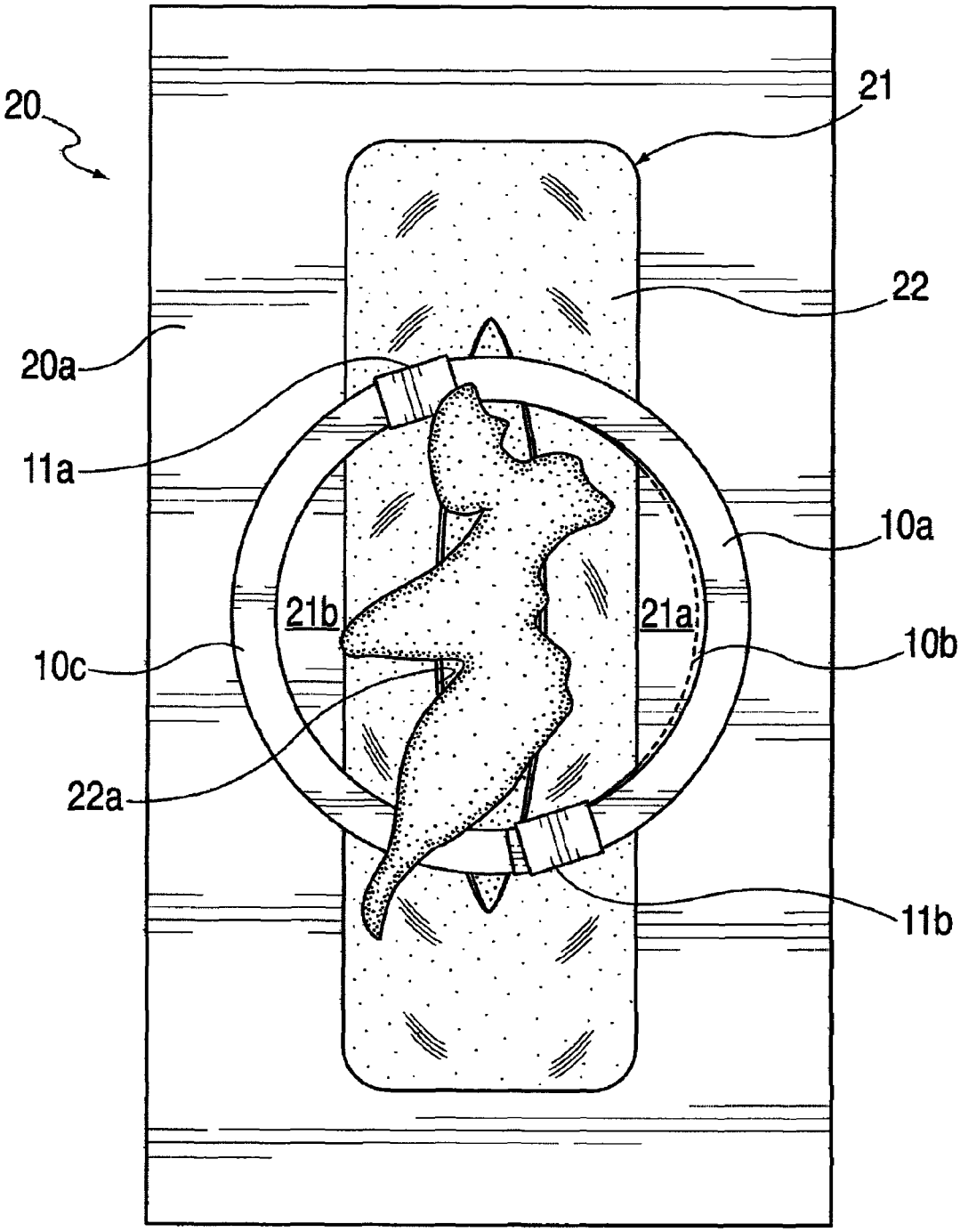
FIG. 2 shows the device in plan view with its top coil clipped onto the sides of a tissue carton and a first tissue pulled up through the hollow of the coil spring and out of a dispenser aperture.

Referring to FIG. 2, the dispensing device is shown in plan view installed on a tissue carton 20. A standard tissue carton is formed as a rectangular box with a dispensing aperture 21 formed on its top surface 20*a*. During manufacture, the aperture is formed with a perforated cutout strip to cover the aperture until it is removed for use. Once the perforated cover strip is removed, the dispensing membrane 22 held within the aperture boundaries is exposed. The dispensing membrane 22 is formed as a plastic film layer with a scored line along its center axis which can be separated with a light finger pressure to provide a membrane opening 22*a* in the center of the top surface of the carton through which tissues are pulled. Due to an elastic force of the plastic membrane film toward its original shape, the membrane opening tends to close on a tissue drawn though the membrane opening and thus acts to retain the leading flap of a following tissue once the leading tissue is pulled away, in order to leave a portion thereof for the user to grasp when withdrawing the next tissue.

An example of a standard large-size tissue carton in use commercially is the 400-tissue count size of KLEENEX™ brand tissue of Kimberly-Clark Worldwide, Inc., Neenah, Wis. The carton's dimensions are 4.75 inches (12.0 cm)

width×8.9 inches (22.6 cm) length×3.9 inches (9.9 cm) height. The top surface aperture dimensions are 2.2 inches (5.6 cm) width×7.0 inches (17.8 cm) length. The aperture's membrane opening is a slit about 4.5 inches (11.4 cm) length. The helical coil spring may therefore be designed to have a diameter of about 4.0 inches (10.2 cm), which would fit with room to spare within the width of the carton while spanning the length of the membrane opening. The coil may be made of thin flat plastic ribbon or metal wire with 6-8 coil turns that compresses to a height of about 0.2 inch (0.5 cm) so that it can be easily inserted between the top surface of the carton and the top of the tissue stack.

The tissue dispensing device TDD may be pre-installed on a manufactured carton or retrofitted by insertion onto the top surface of an existing carton with its top coil 10 having its semicircular upper portion 10*a* (solid lines) abutting the top surface 20*a* of the carton on one lateral side 21*a* bounding the dispenser aperture 21 and its semicircular lower portion 10*b* (dashed lines) abutting the underside of the top surface 20*a* of the carton. In this embodiment, the top coil has its other semicircular portion 10*c* abutting the top surface 20*a* on the other lateral side 21*b* bounding the dispenser aperture 21. Alternatively, the top coil may have its other semicircular portion 10*c* formed with upper and lower portions to clip onto the other lateral side 21*b* bounding the dispenser aperture 21. The TDD coil defines an open circular space spanning almost the full length of the opening 22*a* of the membrane 22 through which tissues may be withdrawn.

Figure 3:
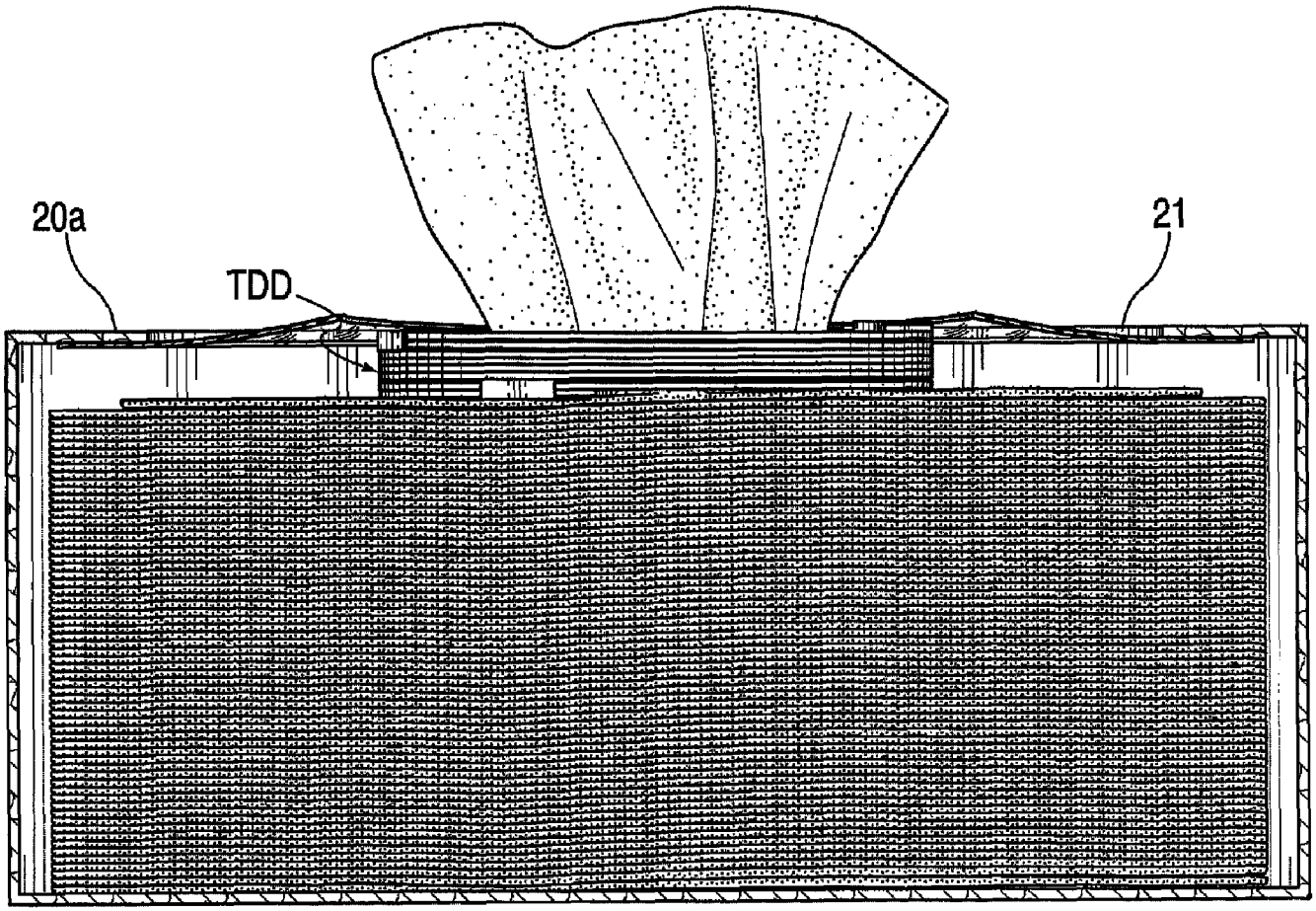
FIG. 3 shows a side cutaway view of a full tissue carton with the device inserted into the carton with its top coil clipped onto the sides of the carton aperture.

FIG. 3 shows a side cutaway view of a full tissue carton with the device inserted into the carton with its top coil clipped onto the sides of the carton aperture. The device has its top coil clipped onto the top surface 20*a* of the tissue carton 20 and the remainder of the helical coil spring TDD is inserted is inserted in the space between the top surface 20*a* and the top of the full stack of tissues. The bottom coil rests on top of the full tissue stack.

Figure 4:
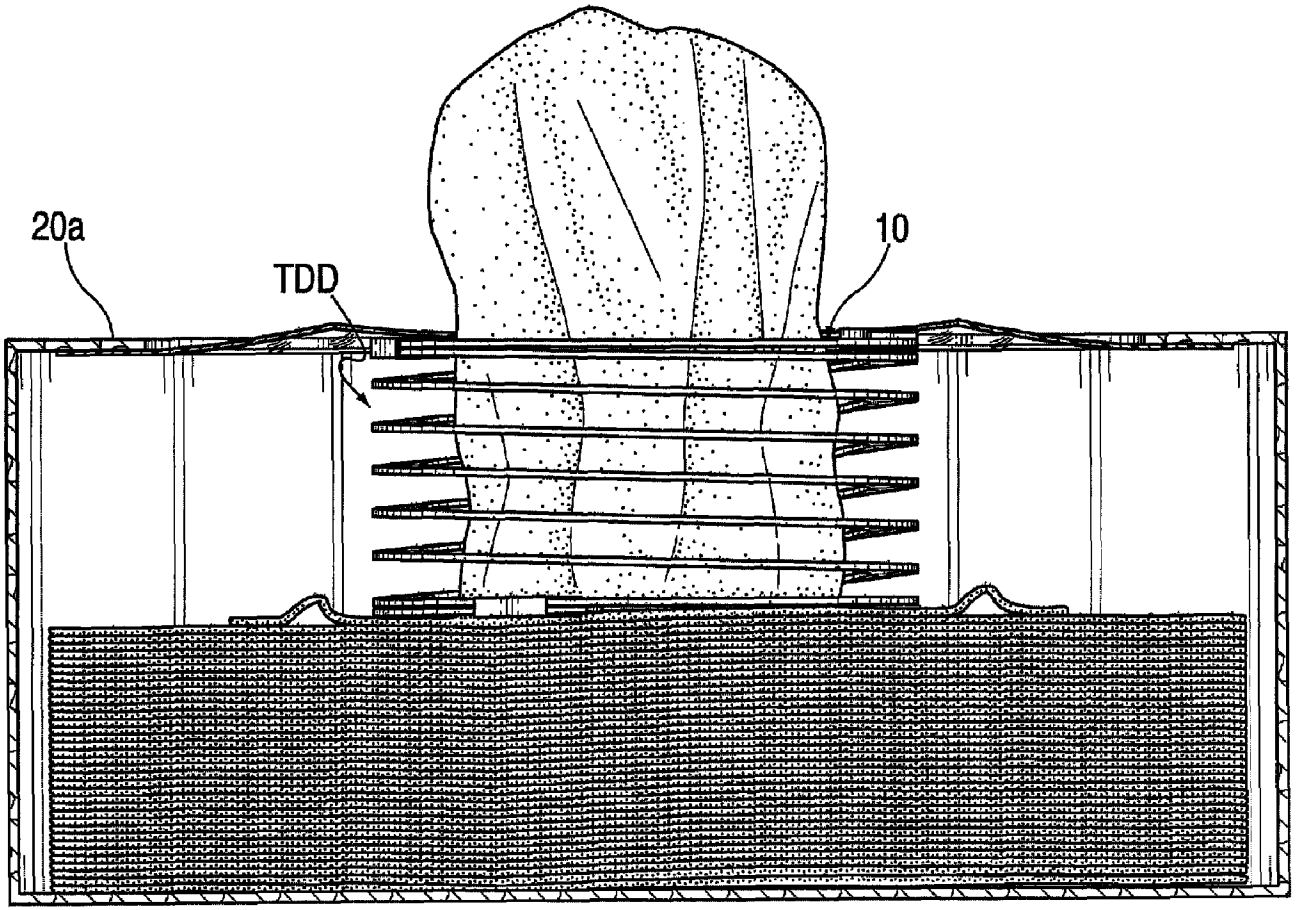
FIG. 4 shows a side cutaway view of a half-empty tissue carton with the coil spring stretchily extending down to and having its bottom coil is resting on top of the tissue stack.

FIG. 4 shows a side cutaway view of a half-empty tissue carton with the coil spring stretchily extending down to and having its bottom coil is resting on top of the tissue stack. The coils of the dispensing device maintains a light pressure force on the tissue stack while its coils providing a vertical support structure to each partially withdrawn tissue to prevent "fall back".

Figure 5:
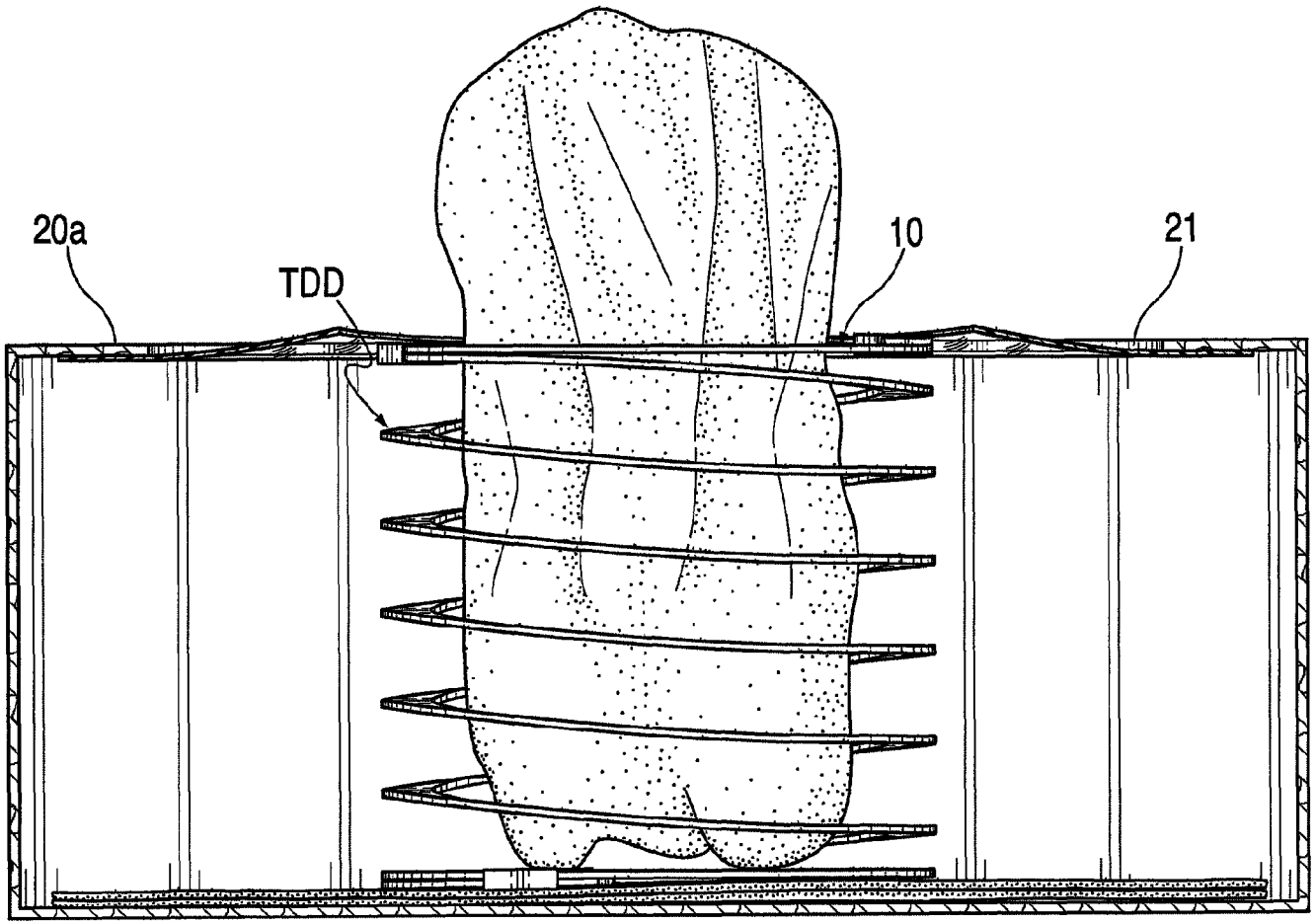
FIG. 5 shows a side cutaway view of a nearly-empty tissue carton with the coil spring fully extending down to and having its bottom coil is resting on top of the tissue stack.

FIG. 5 shows a side cutaway view of a nearly-empty tissue carton with the coil spring fully extending down to and having its bottom coil is resting on top of the tissue stack. The bottom coil 12 maintains a light pressing force on the tissue stack even when it is nearly empty, while the TDD coils provide an elongated vertical support structure to the partially withdrawn tissue to prevent "fall back".

Designing and dimensioning the dispensing device is important to obtaining the improved dispensing benefits of the device. If the dispensing device is too heavy and excessive weight is placed on top of the tissue stack, both the tissue being dispensed and the following interleaved tissue may tear during dispensation and or improper pop-up of the following tissue may occur. The diameter of the coils must be large enough so that the coils extend beyond the width of the carton opening to be securely clipped onto the lateral sides bounding the tissue carton aperture. The coil open space must be large enough so that excessive friction is not created with the tissues as they are withdrawn through the coil opening during dispensation. The outside diameter of the dispensing device must be less than the width of the tissue dispensing carton to permit a relatively loose fit onto the lateral sides of the carton aperture and within the interior of the carton to allow vertical reciprocating movement of the coil spring therein. The dispensing apparatus is designed so that its height in a resting state when the coils are fully compressed together is capable of being inserted into the space between the top surface of the carton and the full stack of tissue prior to any tissue dispensation. Furthermore, the overall height of the dispensing device in its fully elongated state must be taller than the height of the tissue carton so that the bottom coil of the dispensing device is able to rest on top of the tissue stack as it is lowers down to the final tissue.

The coils of the dispensing device create a vertical support structure that supports tissues in a vertically standing position as each following tissue is drawn up within the hollow of the coils. As the stack of tissues lowers within the carton, the bottom end of the coil lowers as a result of gravity to maintain a light downward pressure on the stack of tissues. When a tissue is pulled from the carton, the dispensing coil spring is sufficiently lightweight to allow the bottom end of the coil to move upward with the following tissue until it reaches the top of the box, then the coil spring falls back down under gravity so that the bottom coil again rests on top of the stack of remaining tissues. This up-and-down springing movement allows a tissue to be dispensed while the next tissue's leading flap is pulled upward with it and partially out of the carton (pop-up) so that it is ready to be dispensed next. As the bottom coil of the dispensing device drops back down onto the stack of tissues, the bottom coil puts pressure on the trailing end of the next tissue to support it in a vertical standing position and restrict the tissue from falling back down.

If the helical coil spring and bottom coil does not fully fall back down to rest on top of the tissue stack, it can remain suspended on part of the tissue in the vertical standing position, and the coils will nevertheless create sufficient frictional engagement with the trailing flap of the tissue next to be dispensed and the leading flap of the following tissue to prevent "fall back". The dispensing apparatus is designed and dimensioned to only mildly increase frictional engagement between the tissue being dispensed and the following interleaved tissue to insure that the leading flap of the following tissue is drawn upward through the membrane opening and maintained in an upstanding position so it can be easily grasped by the user for a subsequent dispensing operation. Due to the tissue being mildly squeezed inside the hollow of the coils, the vertically standing part of the tissue is able to maintain in a standing position over the force of gravity.

It is to be understood that many modifications and variations may be devised given the above description of the general principles of the invention. It is intended that all such modifications and variations be considered as within the spirit and scope of this invention, as defined in the following claims.

The invention claimed is:

1. A tissue dispensing device, for use with a standard tissue carton of the type formed as a rectangular box containing a stack of folded, interleaved tissues and having a dispenser aperture formed in a top surface of the tissue carton with a dispensing membrane held within the dispenser aperture which can be separated to provide a membrane opening through which tissues are pulled and which retains a leading part of a tissue for a user to grasp the next tissue to be dispensed, said tissue dispensing device comprising:

a helical coil spring that is highly stretchy and has a top coil provided with means for fastening around the dispenser aperture in the top surface of the tissue carton with the remainder of the helical coil spring inserted into a space between the top surface of the tissue carton and top of the stack of tissues within the carton with a bottom coil thereof resting on top of the stack of tissues, wherein said helical coil spring forms an open circular space within its coils under gravity that provides a vertically-extending support structure for supporting a tissue next to be dispensed from the tissue stack in a vertical standing position with a leading part thereof extending through the membrane opening of the dispenser aperture of the tissue carton to enable a user to grasp the leading part to withdraw the next tissue to be dispensed.

2. A tissue dispensing device according to claim 1, wherein said fastening means is formed by said top coil having conjoined upper and lower coil portions that can be inserted above and below opposite surfaces of at least one lateral side of the tissue-dispenser aperture.

3. A tissue dispensing device according to claim 2, wherein said fastening means is formed by said conjoined upper and lower coil portions being fastened together at points diametrically opposite each other to create cantilevered, semicircular upper and lower portions that clip onto the at least one lateral side of the dispenser aperture.

4. A tissue dispensing device according to claim 2, wherein said fastening means is formed by fastening a first two turns of the helical coil spring together at points diametrically opposite each other to create cantilevered, semicircular upper and lower portions that clip onto the at least one lateral side of the dispenser aperture.

5. A tissue dispensing device according to claim 2, wherein said top coil has another semicircular portion abutting the top surface of the tissue carton on another lateral side bounding the dispenser aperture.

6. A tissue dispensing device according to claim 2, wherein said top coil has another semicircular portion formed with upper and lower portions to clip onto another lateral side of the dispenser aperture.

7. A tissue dispensing device according to claim 1, wherein said helical coil spring is formed of a material with thin dimensions so as to be light in weight and capable of stretching easily to an extended length one or more times greater than its diameter.

8. A tissue dispensing device according to claim 1, wherein said helical coil spring is formed of a low-density plastic ribbon.

9. A tissue dispensing device according to claim 1, wherein said helical coil spring is formed of flat metal wire.

10. A tissue dispensing device according to claim 1, wherein said bottom coil has an end fastened to a coil turn just above it to form a smooth terminal portion to prevent tissues from snagging on the bottom coil or becoming stuck on the bottom coil during tissue dispensation.

11. A tissue dispensing device according to claim 10, wherein said smooth terminal portion is formed by welding the coil end to a coil turn just above it.

12. A tissue dispensing device according to claim 10, wherein said smooth terminal portion is formed by a brace or sleeve connecting the coil end to an adjacent coil above it.

13. A tissue dispensing device according to claim 1, wherein said tissue dispensing device is pre-installed on a manufactured tissue carton.

14. A tissue dispensing device according to claim 1, wherein said tissue dispensing device is retrofitted by insertion onto the top surface of an existing tissue carton.

15. A tissue dispensing device according to claim 1, wherein as successive tissues are pulled and the top of the stack of tissues lowers within the carton, said helical coil spring stretches commensurately to the top of the tissue stack by gravity and the bottom coil rests upon and maintains a light downward pressure on the stack of tissues.

16. A tissue dispensing device according to claim 1, wherein as successive tissues are pulled and the top of the stack of tissues lowers within the carton, the bottom coil of said helical coil spring moves upward with a following tissue interleaved with a leading tissue until it reaches and is retained by the dispenser membrane at the top of the tissue carton, then the bottom coil slides back down by gravity to again rest on the next tissue at the top of the stack of tissues.

17. A dispensing method for adapting a standard tissue carton with a tissue dispensing device, the standard tissue carton being of the type formed as a rectangular box containing a stack of folded, interleaved tissues and having a dispenser aperture formed in a top surface of the tissue carton with a dispensing membrane held within the dispenser aperture which can be separated to provide a membrane opening through which tissues are pulled and which retains a leading part of a tissue for a user to grasp the next tissue to be dispensed, said dispensing method comprising the step of enabling a tissue dispensing device formed as a helical coil spring that is highly stretchy to have a top coil fastened around the dispenser aperture in the top surface of the tissue carton and the remainder of the helical coil spring inserted into a space between the top surface of the tissue carton and top of the stack of tissues within the carton with a bottom coil thereof resting on top of the stack of tissues.

18. A dispensing method for adapting a standard tissue carton with a tissue dispensing device according to claim 17, wherein said tissue dispensing device is retrofitted by insertion of the top coil around the dispenser aperture in the top surface of an existing tissue carton and the remainder of the helical coil spring is inserted into the space between the top surface of the tissue carton and top of the stack of tissues within the carton.

19. An improvement to a standard tissue carton of the type formed as a rectangular box containing a stack of folded, interleaved tissues and having a dispenser aperture formed in a top surface of the tissue carton with a dispensing membrane held within the dispenser aperture which can be separated to provide a membrane opening through which tissues are pulled and which retains a leading part of a tissue for a user to grasp the next tissue to be dispensed, comprising:

a tissue dispensing device formed as a helical coil spring that is highly stretchy and having its top coil fastened around the dispenser aperture in the top surface of the tissue carton and the remainder of the helical coil spring inserted into a space between the top surface of the tissue carton and top of the stack of tissues within the carton with a bottom coil thereof resting on top of the stack of tissues.

20. An improvement to a standard tissue carton according to claim 19, wherein said tissue dispensing device is pre-installed on a manufactured tissue carton.

* * * * *